US011118752B2

(12) United States Patent
Pruitt et al.

(10) Patent No.: US 11,118,752 B2
(45) Date of Patent: Sep. 14, 2021

(54) FLEXIBLE COVER FOR LINEAR LIGHTING CHANNELS

(71) Applicant: Elemental LED, Inc., Reno, NV (US)

(72) Inventors: Adam L Pruitt, Reno, NV (US); Andrew McAleavey, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 84 days.

(21) Appl. No.: 16/773,194

(22) Filed: Jan. 27, 2020

(65) Prior Publication Data

US 2021/0231289 A1 Jul. 29, 2021

(51) Int. Cl.

| | |
|---|---|
| ***F21V 3/10*** | (2018.01) |
| ***F21V 3/02*** | (2006.01) |
| ***F21S 8/02*** | (2006.01) |
| ***F21S 4/20*** | (2016.01) |
| *F21Y 115/10* | (2016.01) |

(52) U.S. Cl.

CPC ..... *F21V 3/02* (2013.01); *F21S 4/20* (2016.01); *F21S 8/024* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 4,941,072 | A | 7/1990 | Yasumoto et al. |
| 5,032,960 | A | 7/1991 | Katoh |
| 6,481,130 | B1 | 11/2002 | Wu |
| 6,739,740 | B1 | 5/2004 | Feldman |
| 6,796,680 | B1 | 9/2004 | Showers et al. |
| 7,111,957 | B2 | 9/2006 | Bernhart et al. |
| 7,758,207 | B1 | 7/2010 | Zhou et al. |
| 7,854,527 | B2 | 12/2010 | Anderson |
| 8,061,865 | B2 | 11/2011 | Piepgras et al. |
| 8,092,038 | B2 | 1/2012 | Liao et al. |
| 8,446,004 | B2 | 5/2013 | Loh et al. |
| 8,459,824 | B1 | 6/2013 | Esmailzadeh et al. |
| 8,616,757 | B2 | 12/2013 | Leadford et al. |
| 8,651,689 | B2 | 2/2014 | Que |
| 8,870,407 | B2 | 10/2014 | Kim et al. |
| 8,888,306 | B2 | 11/2014 | Thomas et al. |

(Continued)

FOREIGN PATENT DOCUMENTS

| | | | |
|---|---|---|---|
| EP | 1934518 | B1 | 9/2009 |
| KR | 101406244 | B1 | 6/2014 |

OTHER PUBLICATIONS

Elemental LED, Inc., "Tape Light Mounting Channels," 2019 Diode LED Catalog, Jan. 2019.

(Continued)

*Primary Examiner* — Elmito Breval

(74) *Attorney, Agent, or Firm* — United IP Counselors, LLC

(57) ABSTRACT

A flexible cover for a linear lighting channel is described, as are enclosures and luminaires using this kind of flexible cover. The flexible cover has sufficient flexibility to be bent or coiled to a bend radius of 6 inches (15.2 cm) or smaller, and can thus be coiled for shipping and uncoiled for installation. Typically, the cover is made of a polymer that is at least translucent. Covers may be made in various shapes, including lens and prism shapes, and channels may be made with sidewalls that make complementary shapes in order to engage with and retain the covers.

13 Claims, 5 Drawing Sheets

(56) References Cited

U.S. PATENT DOCUMENTS

| | | | | |
|---|---|---|---|---|
| 8,992,045 | B2 | 3/2015 | Veerasamy et al. | |
| 9,279,544 | B1 | 3/2016 | Dankelmann et al. | |
| 9,512,984 | B2 | 12/2016 | Tessnow et al. | |
| 9,897,294 | B2 | 2/2018 | Pearson et al. | |
| 9,933,123 | B2 | 4/2018 | Ladstätter | |
| 10,190,738 | B1 | 1/2019 | James et al. | |
| 2003/0021116 | A1 | 1/2003 | Miller et al. | |
| 2004/0201996 | A1 | 10/2004 | Weber | |
| 2007/0019409 | A1* | 1/2007 | Nawashiro | F21V 5/04 362/231 |
| 2008/0218683 | A1 | 9/2008 | Lam et al. | |
| 2008/0266843 | A1 | 10/2008 | Villard | |
| 2009/0091931 | A1 | 4/2009 | Eriksson | |
| 2009/0168419 | A1 | 7/2009 | Daimon | |
| 2011/0286207 | A1 | 11/2011 | Chan et al. | |
| 2012/0092852 | A1* | 4/2012 | Doan | F21K 9/232 362/84 |
| 2012/0120667 | A1* | 5/2012 | Schenkl | F21V 5/02 362/335 |
| 2013/0308303 | A1 | 11/2013 | Greenholt et al. | |
| 2014/0049939 | A1* | 2/2014 | Kuenzler | H04R 1/028 362/84 |
| 2014/0226316 | A1 | 8/2014 | Medendorp et al. | |
| 2014/0252249 | A1* | 9/2014 | Doros | F21V 5/008 250/504 R |
| 2015/0159833 | A1* | 6/2015 | Qiu | F21V 5/04 362/335 |
| 2016/0076746 | A1 | 3/2016 | Porciatti | |
| 2016/0138777 | A1* | 5/2016 | Shen | F21K 9/233 362/308 |
| 2018/0245754 | A1* | 8/2018 | Gensler | F21V 3/049 |
| 2019/0088241 | A1 | 3/2019 | Czech et al. | |
| 2019/0285244 | A1 | 9/2019 | Hawks et al. | |

OTHER PUBLICATIONS

U.S. Appl. No. 16/571,413, filed Sep. 16, 2019, Heredia, Entire document.

U.S. Appl. No. 16/571,537, filed Sep. 16, 2019, Heredia, Entire document.

U.S. Appl. No. 16/571,675, filed Sep. 16, 2019, Heredia, Entire document.

International Search Report issued in International Application No. PCT/US2021/015090 dated Apr. 27, 2021.

Written Opinion issued in International Application No. PCT/US2021/015090 dated Apr. 27, 2021.

* cited by examiner

FLEXIBLE COVER FOR LINEAR LIGHTING CHANNELS

TECHNICAL FIELD

The invention relates to linear lighting, and to flexible covers for linear lighting channels.

BACKGROUND

Over the last 15 years, household and commercial lighting based on LEDs has become increasingly dominant in the marketplace, supplanting traditional incandescent and fluorescent luminaires. Linear lighting, one particular form of LED lighting, typically includes a thin, elongate printed circuit board (PCB) populated with a number of LED light engines, usually spaced at a regular pitch. The PCB may be either flexible or rigid.

One of the most popular ways of using linear lighting is to install it in a channel and cover it with a cover. The channel offers protection, and the cover typically acts as a diffuser, spreading the light and improving the overall appearance, although covers may be used for a wide variety of protective and beam-shaping purposes. The result is a finished luminaire suitable for installation in a variety of locations.

Examples of channels used with linear lighting can be found in U.S. Pat. No. 9,279,544, the contents of which are incorporated by reference in their entirety. The typical channel for linear lighting is a single-piece extrusion, made of metal or plastic, that has a pair of sidewalls and a bottom. The sidewalls of some channels have outwardly-extending flanges, which are typically used for flush-mounting the channels in walls.

Typical covers are made of a relatively hard, relatively rigid polycarbonate or acrylic plastic. While these types of covers may be effective at protecting the linear lighting and, in many cases, diffusing emitted light, their hardness and rigidity means that they are shipped in straight lengths and can be cumbersome to install.

BRIEF SUMMARY

One aspect of the invention relates to an elongate, flexible, polymeric cover for a linear lighting channel. The cover is at least translucent, and may be made in a variety of cross-sectional shapes, including lenses and prisms, and may have straight or angled sides. The cover may, for example, be made of a polyurethane, a silicone, or a polyvinyl chloride polymer.

Another aspect of the invention relates to an enclosure for linear lighting that includes a channel and a cover. The channel is elongate and has sidewalls and a bottom. The cover is elongate, flexible, polymeric, and is at least translucent. The sides of the cover may be angled or otherwise shaped, and the sidewalls of the channel may have complementary angles, grooves, or shapes to engage and retain the cover.

Yet another aspect of the invention relates to a method for installing a polymeric cover in a channel. The method comprises heating the cover to a desired temperature to impart flexibility, installing the cover in the channel, and allowing the cover to cool. In some cases, the method may also comprise, prior to installing, heating the cover to the desired temperature and coiling it.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the figures, and in which.

DETAILED DESCRIPTION

Figure 1:
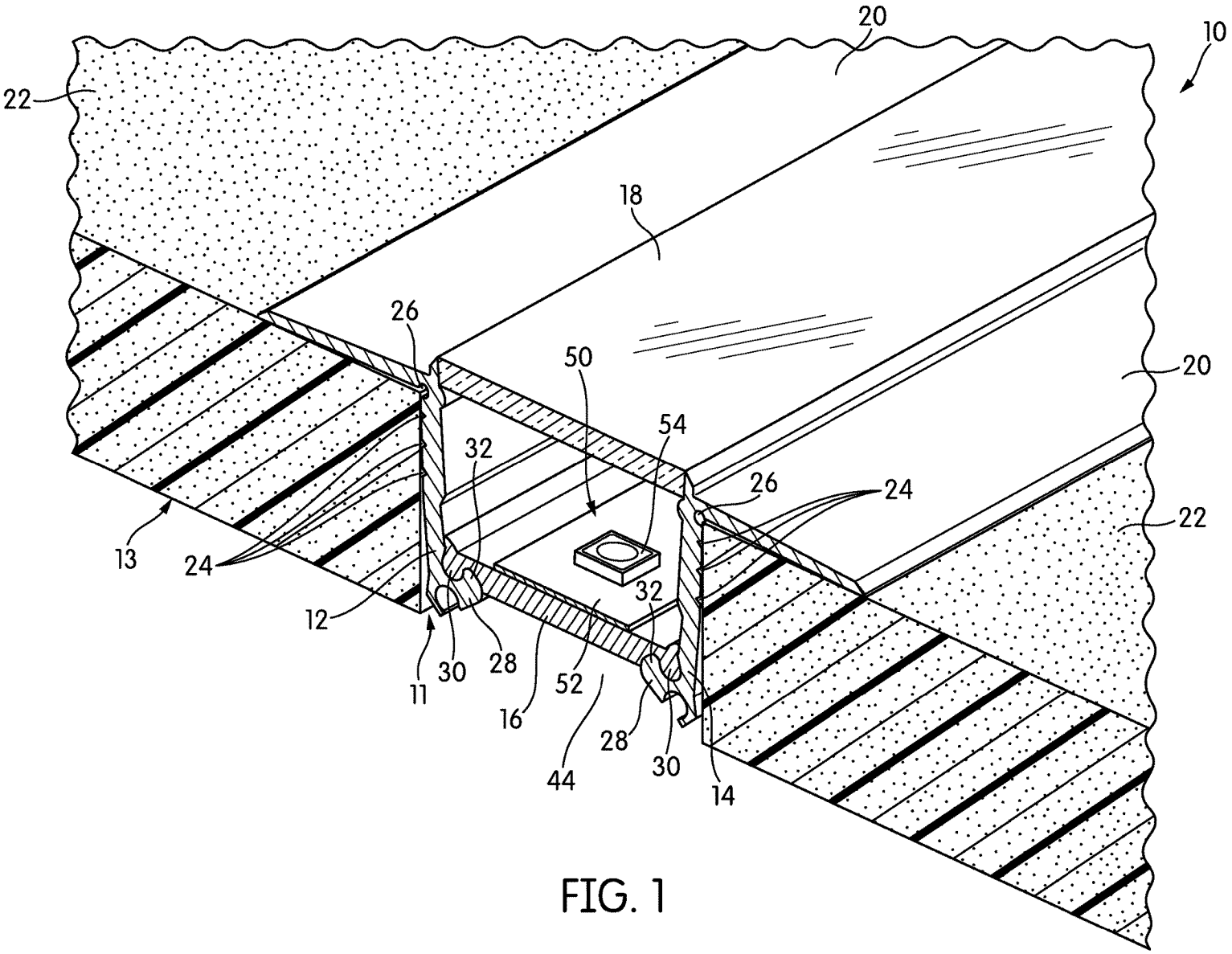
FIG. 1 is a cross-sectional perspective view of a channel with linear lighting and a flexible cover, shown as installed in a portion of a wall.

FIG. 1 is a cross-sectional perspective view of a channel with linear lighting, generally indicated at 10, according to one embodiment of the invention. In the view of FIG. 1, the channel 10 is shown flush-mounted in a slot 11 within a wall 13. However, the channel 10 need not be mounted this way, or have structure to enable this kind of mounting, in all embodiments.

The channel 10 has sidewalls 12, 14 and a bottom 16. A cover 18 covers the channel 10. The sidewalls 12, 14 and the bottom 16 may be separate, modular components that are connected together to form the channel 10, as is described in U.S. Pat. No. 10,663,148, the contents of which are incorporated by reference in their entirety.

In the illustrated embodiment, the sidewalls 12, 14 are mirror images of one another and the bottom 16 is symmetrical about its longitudinal centerline. However, the sidewalls 12, 14 need not be mirror images of one another, and the bottom need not be symmetrical. In the following description, it is assumed that the channel 10 has a constant cross-sectional shape over its entire length. The sidewalls 12, 14 and bottom 16 would typically be made by extrusion of a metal or plastic, such as aluminum, polycarbonate, or ABS, although these components could be made by casting, machining, or other such formation processes. The precise material that is used will usually depend on the application: metal channels provide rigidity, thermal conductivity, and longevity, but for certain applications, the lower weight and lower cost of plastic channels may be helpful.

Figure 2:
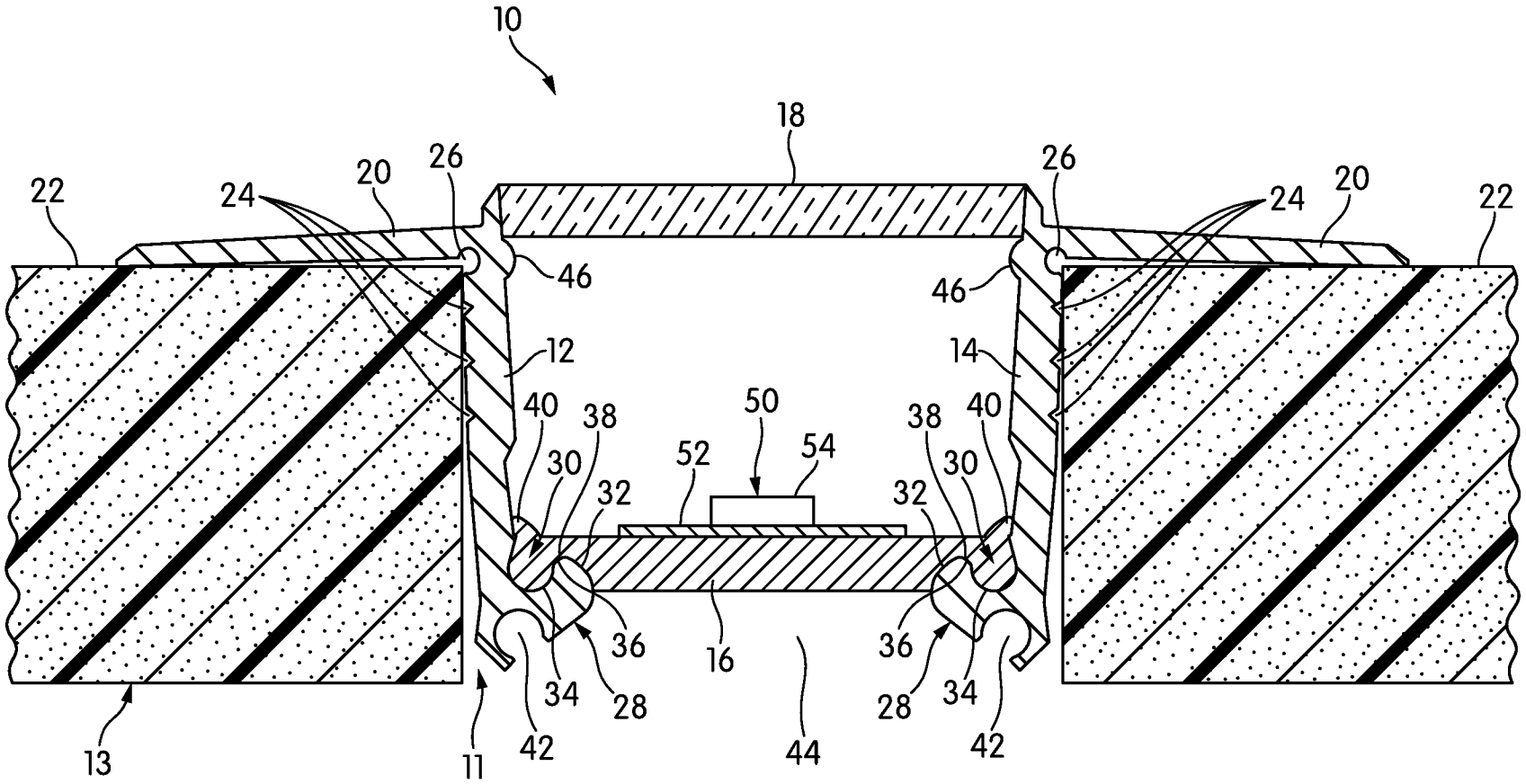
FIG. 2 is a cross-sectional view of the channel of FIG. 1.

As shown in FIG. 1 and in FIG. 2, a cross-sectional view, the channel 10 is designed for flush-mounting in walls. To that end, each sidewall 12, 14 turns outwardly approximately 90°, forming a side flange 20. Installed, the flanges 20 rest overtop the wall surfaces 22 on either side of the slot 11, with the sidewalls 12, 14 and bottom 16 of the channel 10 recessed behind the wall surfaces 22. As shown, the flanges 20 sit slightly below the tops of the sidewalls 12, 14, forming a slight lip 21 between the flanges 20 and the tops of the sidewalls 12, 14.

In many installations, a joint compound, or another type of adhesive, is used to secure the channel 10 to the wall surfaces 22 and, more generally, within the slot 11. Thus, while FIGS. 1 and 2 show the flanges 20, in actual installations, the flanges 20 may be covered by layers of joint compound, paint, and other such things. Of course, a channel 10 need not be mounted this way or include flanges 20 to allow for such mounting.

The channel 10 of the illustrated embodiment has structure to improve adhesion when installed in a traditional way with a joint compound. Specifically, the undersides of the flanges 20 and the outer surfaces of the sidewalls 12, 14 carry flutes 24 that provide additional surface area for a joint compound or other adhesive to secure the channel 10 within the wall surfaces 22. Additionally, at each joint between the sidewall 12, 14 and the flange 20, a groove 26 is formed. The groove 26 provides space for the joint compound to flow into, and may provide better adhesion between the channel 10 and the wall surfaces 22.

Toward their lower ends, opposite the flanges 20, each sidewall 12, 14 carries engaging structure 28 for engaging with the bottom 16. On each side, the bottom 16 carries complementary engaging structure 30. The engaging structure 28 may be male or female, or it may have both male and female elements. Similarly, the complementary engaging structure 30 may be male, female, or have both male and female elements. In most cases, the complementary engaging structures 28, 30 will offer at least a tight fit, and in some cases, they may be physically interengaged. Preferably, the complementary engaging structures 28, 30 are such that the sidewalls 12, 14 and bottom 16 can be pushed together to engage, snapped together, or slid together, depending on the embodiment.

As shown in FIG. 2, each of the sidewalls 12, 14 of the illustrated embodiment has an inwardly-extending flange that serves as the engaging structure 28. The flange 28 terminates in a bulbous projection 32 that extends upwardly, at an angle to vertical, and creates an upwardly-opening, at least semicircular groove 34 in the flange 28. A complementary projection on each side of the bottom 16 serves as the complementary engaging structure 30. The main extent of the projection 30 matches the shape of the groove 34 and rests in it. The upper tip 36 of the bulbous projection 32 rests in a complementary notch 38 provided in the underside of the bottom 16. Thus, the bottom 16 and each sidewall 12, 14 are interengaged by at least a tight fit. An upper portion 40 of the complementary projection 30 on the bottom 16 extends upwardly and to the side, resting flush with the inner surface of the sidewall 12, 14.

As is also shown in FIG. 2, the sidewalls 12, 14 and bottom 16 may form other engaging structures that may be used to connect the channel 10 with other structures. In the illustrated embodiment, each flange 24 also carries a downwardly-opening at least semicircular groove 42 for this purpose. These grooves 42 may be used, for example, to hold alignment pins that are used to align and join multiple sections of the channel 10 together.

If the bottom 16 is narrow and light, the engagement with the sidewalls 12, 14 may be sufficient to hold it in place when the channel 10 is in use. However, if the bottom 16 is wider or made of a particularly heavy material, some additional mode of securement may be helpful in keeping the bottom 16 in position. For that reason, and as will be described below in more detail, the bottom 16 may include slots, channels, or grooves allowing it to mount directly to fixed structures in or on a wall, or in other locations. More generally, the channel 10 as a whole may be made to use any kind of standard channel mounting clip, including spring-loaded mounting clips that allow the channel 10 to be snapped into a desired position.

As can be appreciated from FIG. 2, there is some space 44 between the underside of the bottom 16 and the lower ends of the sidewalls 12, 16. This space 44 may be used as a raceway for wiring that powers or controls the linear lighting 50.

Linear lighting 50 is disposed on the upper surface of the bottom 16. The linear lighting 50 has a printed circuit board (PCB) 52 on which are disposed one or more LED light engines 54, typically spaced at a regular pitch along the length of the PCB 52. Beyond that, the linear lighting 50 may be of any type. More specifically, it may accept either low voltage or high voltage; it may have a flexible printed circuit board (PCB) or a rigid one; it may be either bare or encapsulated; it may accept either AC power or DC power; and it may emit one color or a plurality of colors. As for the operating voltage of the linear lighting, while the definitions of "low voltage" and "high voltage" vary depending on the authority one consults, for purposes of this description, voltages over about 50V will be considered to be high voltage. High voltage typically brings with it certain requirements, for example, that the linear lighting in question be encapsulated by an electrical insulator. Even if the linear lighting 50 is low voltage, encapsulation may give the linear lighting 50 greater ingress protection, making it more resistant to dirt, water, and the elements.

The bottom 16 of the channel 10 may be ruled or grooved along its length as a guide for alignment of the linear lighting 50 while it is installed. A portion of the bottom 16 may also be recessed or include a shallow trough in some embodiments in order to make alignment and installation of the linear lighting 50 easier. In the channel 10 of FIG. 2, the bottom 16 includes a groove 56 along its longitudinal centerline. The groove 56 provides a visual reference point for aligning the linear lighting 50 during installation.

Of course, the linear lighting 50 need not always be installed on the bottom 16. In some cases, linear lighting 50 could be installed on one of the sidewalls 12, 14. This is typically done to increase diffusion by reflecting the light from the linear lighting 50 off of the opposite sidewall 12, 14 before it exits the channel 10 through the cover 18.

The upper interior portions of the sidewalls 12, 14 may have any structure, such as grooves, recesses, or flanges, that is necessary or desirable for the mounting of the cover 18. In the illustrated embodiment, slight, rounded inward ridges 46 on the upper interior portions of the sidewalls 12, 14 help to mount and support the cover 18. The cover 18, typically made of transparent or translucent plastic, serves to protect the linear lighting 50 and, in most cases, to diffuse the light from the linear lighting 50 as it exits the channel 10. Alternatively, as in the present case, the fit between the cover 18 and the sidewalls 12, 14 may be frictional and based on the relative sizes of the components.

In the illustrated embodiment, the cover 18 is a long piece of rectangular cross section. It is relatively thick. In most embodiments, the cover 18 will be at least 2 mm thick, and some embodiments of covers 18 may be 3-5 mm thick or more. The cover 18 has a solid cross-section.

In contrast to the typical cover for a linear lighting channel, the cover 18 is flexible. "Flexible," as that term is used here, means that the cover 18, in its final, installable form, can be bent to a bend radius of 6 inches (15.2 cm) or smaller without damage and can be restored to its original shape, also without damage. This kind of flexibility may make it easier to ship covers 18 in coiled lengths, and it may also make it easier to install the covers 18.

While the functional definition of flexibility provided above may be the most useful determinant of whether or not a cover, or a prospective material for a cover, has the necessary attributes to be used as a cover 18 according to embodiments of the present invention, there are a number of material properties that can be readily measured and that would tend to indicate that the material is likely to be suitable.

In engineering discussions, flexibility is often defined in terms of an elastic modulus, bending modulus, or torsional modulus. These moduli are derived from the stress-strain relationship during tensile, bending, or torsional testing, respectively. It is possible, for example, to determine the elastic moduli of a range of polymeric materials and correlate those moduli with the kind of functional flexibility described above to determine which materials would be most suitable for use as a cover 18. However, this kind of testing is difficult to do and requires a good deal of equipment, as well as significant expertise. Therefore, simpler tests that correlate well with flexibility may be used.

For example, the present inventors have found that a durometer hardness of 65-75 Shore A at room temperature, according to ASTM D-2240, is one indication that the material in question may have the necessary flexibility. "Room temperature" refers to a temperature range of 20-25° C. (69-77° F.).

There are many materials that are potentially suitable for use in making covers 18, including both thermoplastic polymers and thermoset polymers. Typically, the polymer is at least translucent, and without additives, it may be fully transparent. Examples include silicone polymers, polyurethane polymers, and polyvinylchlorides (PVC). These base polymers may have any number of additives for flexibility, UV resistance, flame retardance, and other common traits of commercial plastics. As one specific example, the two part polyurethane system including SEPUR 540 RT and DK 100 HV (Special Engines S.E. s.r.l., Torino, Italy), mixed as directed, may be suitable. As another example, Dow SILASTIC™ moldable optical silicones may be suitable. Depending on the material, the cover 18 may be molded, cast, extruded, or made in any other suitable way.

Ultimately, flexibility is a function of several different things. The nature of the polymer itself is one determinant of flexibility, but at least for some polymers, the ambient temperature is another determinant. Many polymers have a glass transition temperature ($T_g$). Above the glass transition temperature, the polymer is more flexible, and may be rubbery. Below the glass transition temperature, the polymer tends to be more rigid.

If a polymer is too rigid at room temperature to have the necessary flexibility, but is otherwise suitable for use as a cover 18, it may be possible to temporarily heat the polymer to a temperature above its glass transition temperature in order to impart flexibility. For example, the SEPUR 540 RT/DK 100 HV two-part polyurethane system described above has a glass transition temperature of 18° C. when cured, just below room temperature. Thus, if this material is stored in a colder warehouse or processed in a colder manufacturing plant, it may not meet the definition of flexibility set forth above. In that case, the material may be temporarily heated in order to coil it for storage and shipping. If the ambient temperature at the installation site is also below the polymer's glass transition temperature, the material may be similarly heated for uncoiling and installation.

While this description refers specifically to glass transition temperature, some polymers simply become more flexible as they are heated and may be flexible enough to be used if heated without exceeding the glass transition temperature. Thus, any amount of heat may be applied in order to make a polymer more flexible for use, whether or not the applied heat causes the polymer to exceed its glass transition temperature, so long as the applied heat does not damage the polymer.

If heating is necessary, the heat may be dry heat (e.g., from heat lamps or hot air guns) or wet heat (e.g., immersion in heated or boiling water or another liquid). In the case of wet heat, the exposure may be direct or indirect: for indirect exposure, the cover 18 may be sealed in a bag or protected from direct exposure to the liquid in some other manner in order to prevent absorption or degradation of the polymer. A polymer should not be heated to a temperature that damages it, but beyond that basic limitation, any temperature may be used. The heating temperature will depend on the particular polymer and its characteristics, including the glass transition temperature.

Beyond additives for manufacturability, flexibility, and other such purposes, cover materials may also have additives to modify the light that passes through them. Additionally, while the cover 18 is rectangular in cross-sectional shape, covers according to embodiments of the invention may have a variety of different shapes.

In embodiments of the present invention, one objective of most covers is to provide diffusion. "Diffusion," as that term is used here, refers to the spreading or scattering of transmitted or reflected beams of light, typically by transmission through a non-uniform medium or refraction at a non-uniform surface or interface. Diffusion gives the light emerging from a channel a uniform appearance and, preferably, reduces the prominence of the individual spots of light created by the LED light engines. A typical diffusing cover is at least somewhat opaque—filled with a colorant or dye that causes light scattering. However, other types of diffusing additives may be used, such as titanium dioxide microspheres, silica, and fused silica. If a diffusing additive is added to a base polymer, the diffusing additive may be added uniformly throughout the base polymer, or it may be added in a layer on one or both sides, e.g., by co-extruding a material with the base polymer or by coating the material on the formed base polymer.

In some cases, covers according to embodiments of the invention may have the attributes of lenses or prisms, typically to add to the diffusion by spreading the light, although the thickened sections of lenses or prisms may also provide for greater diffusion simply because the light must pass through more material. Lenses or prisms may also be used to direct the light in some embodiments, or to establish a particular beam angle, and may or may not be opaque. The term "lens," as used in this description, refers to an element with at least one curved surface that is intended to refract and direct light. The term "prism," as used in this description, refers to an element with flat, angled sides that is intended to refract and direct light.

Figure 3:
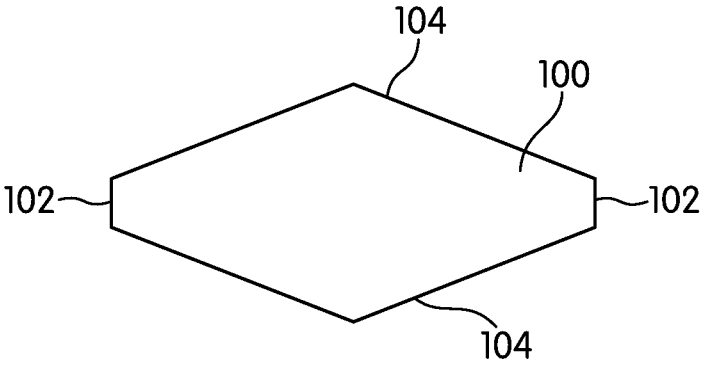
FIGS. 3-5 are end-elevational views illustrating various possible shapes of flexible covers according to other embodiments of the invention.
Figure 4:
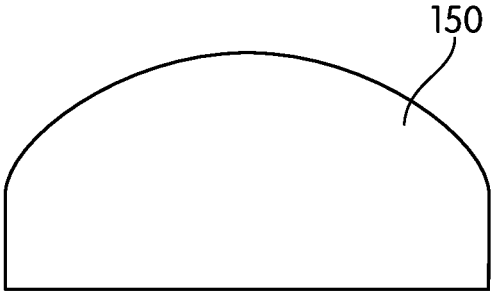
Figure 5:
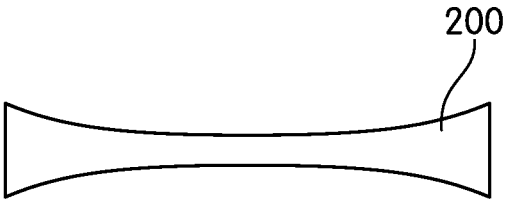

FIGS. 3-5 are end-elevational views illustrating other potential cross-sectional shapes for a cover 18. The cover 100 of FIG. 3 is hexagonal in overall shape with short, squared, vertical sides 102 and long sides 104 that peak at the centers of the top and bottom of the cover 100. The cover 100 can be considered a prism. The cover 150 of FIG. 4 has the shape of a plano-convex lens. The cover 200 of FIG. 5 has the shape of a biconvex lens. Each of FIGS. 1-5 assumes that the cover 18, 100, 150, 200 has a constant cross-section along its entire length. However, in some cases, covers may be made in segments and shaped in both the longitudinal and transverse directions.

Flexible covers according to embodiments of the invention may also be given specific shapes in order to engage with the channels in which they rest and for other purposes.

Figure 6:
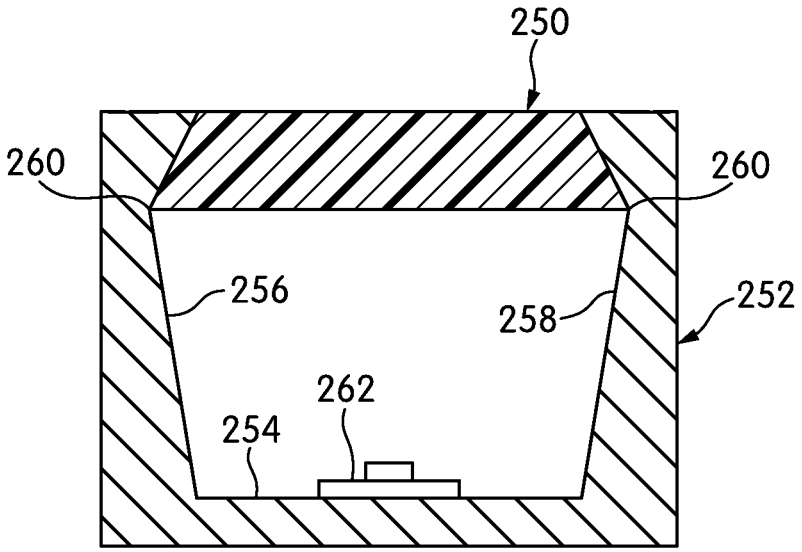
FIG. 6 is a cross-sectional view of a channel and cover according to another embodiment of the invention.

FIG. 6 is cross-sectional view of a cover 250 shown as installed in a channel 252. The cover 250 itself has a trapezoidal cross section, with the base, the wider side, facing down. The channel 252 has a bottom 254 and a pair of sidewalls 256, 258. The sidewalls 256, 258 are mirror images of one another. Each sidewall 256, 258 is relatively thick near the bottom 254 and cants outwardly as it extends upwardly. At inflection points 260 proximate to the top, the sidewalls 256, 258 cant inwardly, matching the slopes of the sides of the trapezoidal cover 250. In other words, the sidewalls 256, 258 of the channel 252 and the cover 250 are shaped to engage one another in a way that keeps the cover 250 a set distance away from the bottom 254 and also locks the cover 250 into place. The cover 250 may be slipped in from one end of the channel 252. Alternatively, if the cover 250 is sufficiently flexible and resilient, it may be inserted in some cases using a rubber mallet, or another similar tool, to pound it into place from the top.

In the view of FIG. 6, the outer sidewalls are vertical, and the interior shapes of the sidewalls 256, 258 are achieved by varying their thicknesses. In some cases, the sidewalls could simply be bent inward or otherwise contoured as needed.

A strip of linear lighting 262 is shown installed on the bottom 254 of the channel 252. The strip of linear lighting 262 is centered in FIG. 6, but in other embodiments, there could be multiple strips of linear lighting 262. Additionally, the bottom 254 itself need not be flat. In some cases, the bottom 254 could be angled. The bottom 254 and sidewalls 256 could also be modular and separable from one another, as was described briefly above.

Figure 7:
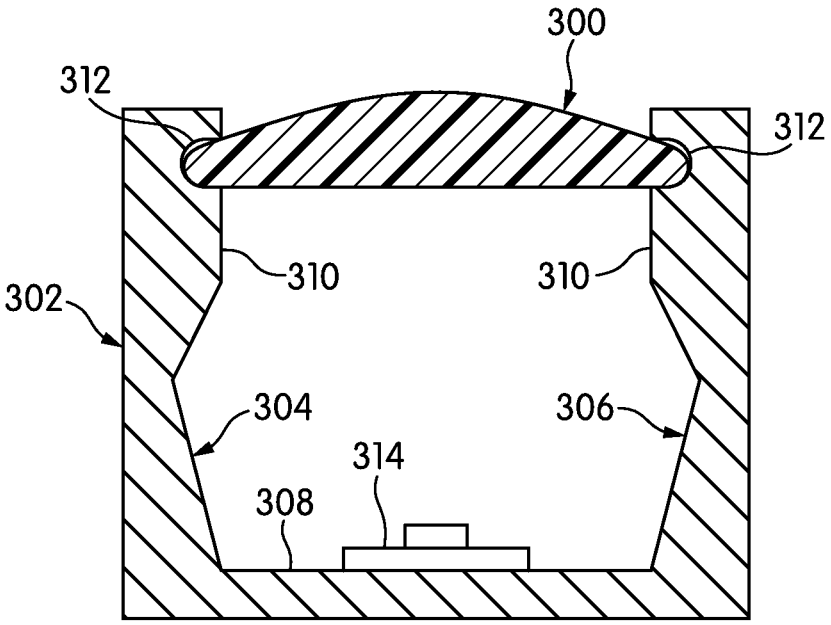
FIG. 7 is a cross-sectional view of a channel and cover according to yet another embodiment of the invention.

FIG. 7 is a cross-sectional view of a cover 300 installed in a channel 302. The cover 300 has the form of a relatively thin plano-convex lens, and is oriented with the convex side up. The channel 302 includes a pair of sidewalls 304, 306 and a bottom 308. The pair of sidewalls 304, 306 are again mirror images of one another. Like the channel 252 of FIG. 6, they vary in thickness with the outer sides remaining vertical. Specifically, the sidewalls 304, 306 cant outwardly from the base 308, reach inflection points, cant inwardly for a distance, and then extend vertically near the top. In the upper vertical section 310 of each sidewall 304, 306, a groove 312 is formed that is shaped and sized to accommodate the sides of the cover 300. The grooves 312 thus retain the cover 300 in the channel 302. A strip of linear lighting 314 is shown installed on the bottom 308 of the channel 302. As with the channel 252 of FIG. 6, the features of the channel 302 could be defined by bending the sidewalls, rather than altering their thicknesses.

While the channels 10, 252, 302 described above each have some structural feature to retain their respective covers 18, in some cases, the engagement of a cover with a channel may be frictional or by press-fit. In some cases, the cover may be made slightly oversized, e.g., slightly wider than the channel, and pressed into place with a rubber mallet, a roller, or another, similar, tool.

Figure 8:
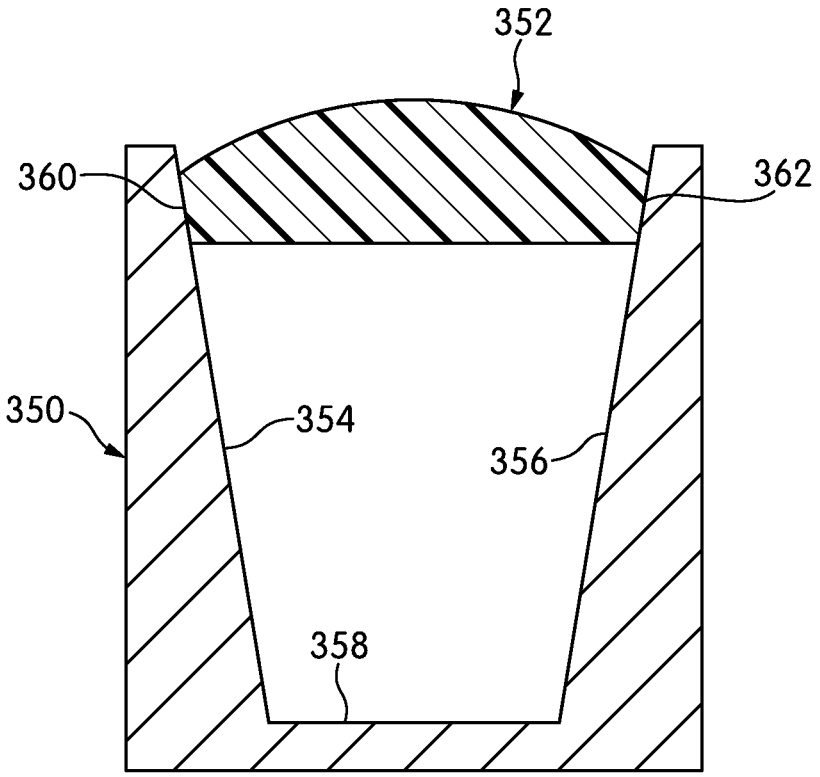
FIG. 8 is a cross-sectional view of a channel and cover according to a further embodiment of the invention.

FIG. 8 is a cross-sectional view of a cover 350 in a channel 352. The channel 352 has sidewalls 354, 356 that, like the other embodiments, are mirror images of one another, and a bottom 358. In the channel 352, the interior sidewalls 354, 356 are angled and straight, thick at the bottom and canting outwardly as they rise. Like the other embodiments, the exterior sidewalls are vertical. The cover 350 has edges 360, 362 that are angled to match the cant of the interior sidewalls 354, 356. The interior sidewalls 354, 356 are smooth; they have no particular structure to retain the cover 350. The fit between the cover 350 and the channel 352 is thus a frictional fit, or if the cover 350 is oversized, a press fit. In addition to the engagement between channel 352 and cover 350, the arrangement of FIG. 8 may also have the advantage that there is no overhanging channel structure that might cast shadows on the cover 350. That is, light from linear lighting in the channel 352 is unobstructed by the sidewalls as it moves toward the cover 350.

In each of the above cases, the sidewalls of the channels are symmetrical mirror images of one another. However, as was noted briefly above, that need not always be the case. In some cases, it may be helpful to have one set of features on one interior sidewall and another set of features on the opposite sidewall. For example, one sidewall could have a groove to receive all or part of the cover, while the other sidewall is flat or angled, relying on frictional or press-fit engagement.

This description presents certain examples of channels and covers. Additional examples of channels and covers may be found, inter alia, in U.S. patent application Ser. No. 16/571,413, filed Sep. 16, 2019, the contents of which are incorporated by reference in their entirety. Any of the covers in that application may be made flexible in accordance with embodiments of the present invention.

There is no particular limitation on the width of a channel cover according to embodiments of the invention. As a practical matter, many channel covers according to embodiments of the invention will be on the order of 1 inch (2.5 cm) to 2 inches (5 cm) wide, although wider covers may be made in some cases. If a cover is particularly wide, it may be helpful if it is at least somewhat stiffer than a narrower cover.

While the invention has been described with respect to certain embodiments, the description is intended to be exemplary, rather than limiting. Modifications and changes may be made within the scope of the invention, which is defined by the appended claims.

What is claimed is:

1. An enclosure for linear lighting, comprising:

an elongate channel having a bottom and sidewalls that arise from either side of the bottom; and an elongate, flexible, polymeric cover for a linear lighting channel, the cover being at least translucent and being constructed and arranged to engage the channel.

2. The enclosure of claim 1, wherein the channel is comprised of metal or plastic.

3. The enclosure of claim 1, wherein the cover is comprised of a polyurethane, a silicone, or a polyvinyl chloride polymer.

4. The enclosure of claim 1, wherein the cover is shaped as a prism or lens.

5. The enclosure of claim 1, wherein the cover has straight sides.

6. The enclosure of claim 1, wherein the cover has angled sides.

7. The enclosure of claim 6, wherein the cover has the cross-sectional shape of a trapezoid.

8. The enclosure of claim 6, wherein the sidewalls are complementarily angled to engage the cover.

9. The enclosure of claim 8, wherein at least a portion of the sidewalls are canted inwardly.

10. The enclosure of claim 8, wherein at least a portion of the sidewalls are canted outwardly.

11. The enclosure of claim 1, wherein upper portions of the sidewalls have interior grooves to engage the channel.

12. A method of installing a cover in a channel, comprising:

heating an elongate, polymeric cover to a specified temperature;

uncoiling the cover;

installing the cover in the channel while heated; and allowing the cover to cool.

13. The method of claim 12, wherein the specified temperature is a glass transition temperature of the cover.

* * * * *